US008087604B2

(12) United States Patent
Palfreman et al.

(10) Patent No.: US 8,087,604 B2
(45) Date of Patent: Jan. 3, 2012

(54) ROLLING MILL POURING REEL AND ITS METHOD OF OPERATION

(75) Inventors: Matthew Palfreman, Charlton, MA (US); T. Michael Shore, Princeton, MA (US)

(73) Assignee: Siemens Industry, Inc., Alpharetta, GA (US)

( * ) Notice: Subject to any disclaimer, the term of this patent is extended or adjusted under 35 U.S.C. 154(b) by 434 days.

(21) Appl. No.: 12/061,091

(22) Filed: Apr. 2, 2008

(65) Prior Publication Data

US 2009/0249852 A1 Oct. 8, 2009

(51) Int. Cl.
*B21C 47/24* (2006.01)

(52) U.S. Cl. ..... 242/362.2

(58) Field of Classification Search ..... 242/362.2, 242/362, 360, 363, 362.3, 361.2, 361.3, 615.1, 242/615.3, 615, 157 R, 472.5, 362.1, 361.1, 242/361; 72/142–144, 66, 135; 140/92.1, 140/92.2

See application file for complete search history.

(56) References Cited

U.S. PATENT DOCUMENTS

| | | | | |
|---|---|---|---|---|
| 2,227,442 | A | 1/1939 | DeMillar | |
| 3,880,376 | A * | 4/1975 | Svensson | 242/362.3 |
| 4,450,702 | A | 5/1984 | Larson et al. | |
| 4,644,773 | A | 2/1987 | Duri | |
| 5,927,634 | A | 7/1999 | Grenz et al. | |
| 5,992,785 | A | 11/1999 | Grenz | |
| 7,004,419 | B2 | 2/2006 | Hsu | |
| 7,100,863 | B2 | 9/2006 | Hsu et al. | |
| 2004/0211851 | A1 | 10/2004 | Barton et al. | |

FOREIGN PATENT DOCUMENTS

| | | |
|---|---|---|
| GB | 1240150 | 7/1971 |

* cited by examiner

*Primary Examiner* — William E Dondero

(57) ABSTRACT

A pouring reel for forming a long product moving at an incoming velocity into an annular coil comprises a central mast lying on a vertical axis. A cylindrical tub surrounds and cooperates with the mast to form an annular chamber, the bottom of which is closed by a coil plate. An entry pipe is arranged to deliver the product downwardly for accumulation in the chamber as a series of superimposed rings forming the annular coil. A first drive mechanism rotates the tub about the vertical axis, and a second drive mechanism rotates the mast about the same axis. The first and second drive mechanisms are operable independently of each other to thereby permit the tub and the mast to be rotated at surface velocities substantially matching the incoming velocity of the product.

The tub and entry pipe may also be vertically adjustable in unison relative to the central mast and coil plate in order to maintain the free fall distance of product being delivered into the chamber at a predetermined substantially constant minimum.

9 Claims, 6 Drawing Sheets

ROLLING MILL POURING REEL AND ITS METHOD OF OPERATION

BACKGROUND OF THE INVENTION

1. Field of the Invention

This invention relates to rolling mill pouring reels for forming hot rolled products such as rods, bars, and the like into annular coils.

2. Description of the Prior Art

In a conventional rolling mill pouring reel, rods, bars and the like (hereinafter collectively referred to as "product(s)") are directed downwardly at an angle into an annular coil forming chamber defined by the outer surface of a central mast and the inner surface of an outer tub. The mast and tub are rotatably driven as a single unit, and the product is gathered in the coil forming chamber as a series of superimposed rings which gradually accumulate to form an upstanding coil. The free fall distance through which the product drops in an uncontrolled manner will vary throughout the coil forming cycle, and this in turn will adversely affect uniform distribution of the rings and stability of the coil. This problem is exacerbated by the difference in surface velocities of the mast and the outer tub, which because they rotate as a single unit, have a fixed relationship, making it impossible to match the surfaces that define the sides of the coil forming chamber to the incoming velocity of the product. Moreover, because of the considerable depth of the coil forming chamber, the entering product must be directed downwardly at a relatively steep angle, which causes the tail end of the product to project upwardly from the completed coil.

The objective of the present invention is to provide an improved pouring reel which avoids or at least substantially mitigates these problems.

SUMMARY OF THE INVENTION

In accordance with one aspect of the present invention, the central mast and the surrounding tub are rotatably driven by independently operable drive mechanisms. With this arrangement, the mast and tub can be driven at different speeds selected to substantially match the incoming velocity of the product being coiled.

In accordance with another aspect of the present invention, the tub is vertically adjustable along with the entry pipe through which the product is directed into the coil forming chamber. The tub and entry pipe can thus be raised gradually as the height of the coil increases. This in turn makes it possible to keep the free fall distance of the product into the coil forming chamber both at a minimum and substantially constant throughout the coil forming cycle.

In accordance with still another aspect of the present invention, an entry guide is interposed between the entry pipe and the coil forming chamber. The entry guide defines a curved path which preferably is concentric with the axis of the central mast and which leads downwardly from the entry pipe into the coil forming chamber. The entry guide includes a plurality of hold down rollers arranged in a horizontal plane at the terminus of the curved path. The entry guide is vertically adjustable during the coil forming cycle to maintain the hold down rollers at a selected distance above the uppermost rings gathering in the coil forming chamber. The curvature of the guide path serves to preform the product into the desired circular configuration, and the hold down rollers serve to vertically confine rings that might otherwise be raised by virtue of being in frictional contact with the tub as it is gradually elevated during the coil forming cycle.

BRIEF DESCRIPTION OF THE DRAWINGS

These and other features and attendant advantages of the present invention will now be described in further detail with reference to the accompanying drawings, wherein.

DETAILED DESCRIPTION OF THE INVENTION

Figure 1:
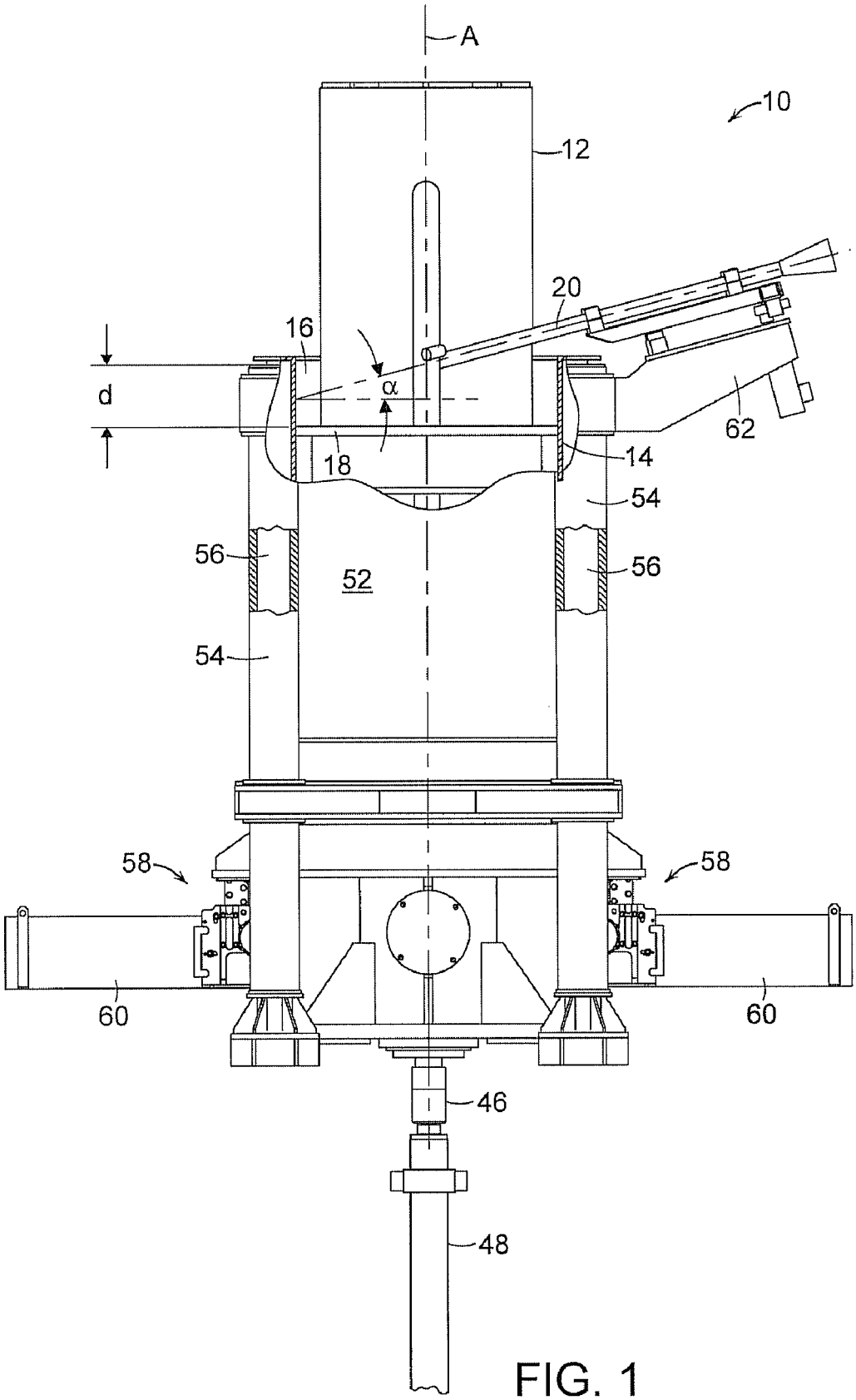
FIG. 1 is a side elevational view, with a portion broken away, showing a pouring reel in accordance with the present invention at the start of a coil forming cycle.
Figure 2:
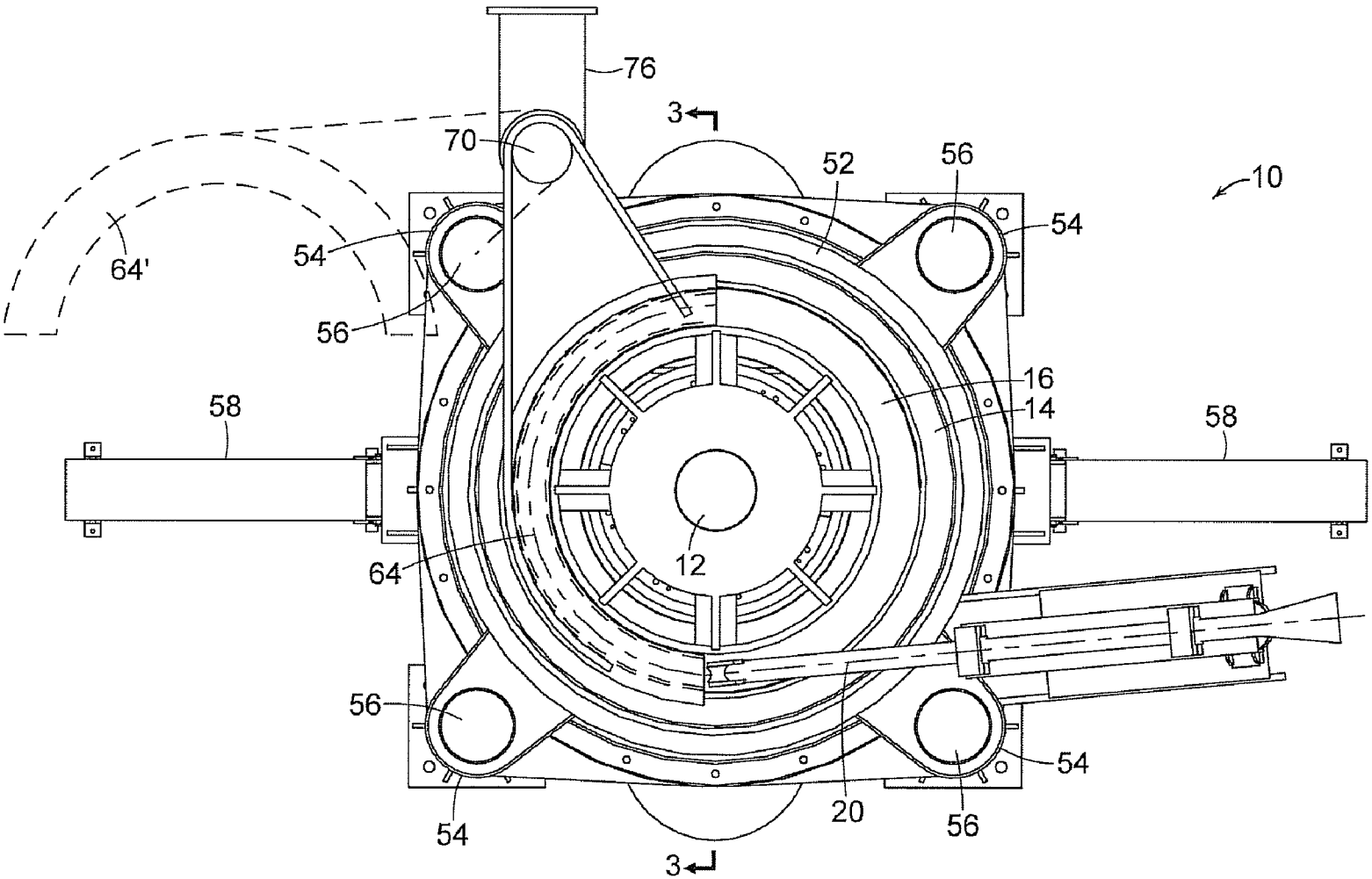
FIG. 2 is a plan view on an enlarged scale of the pouring reel as depicted in FIG. 1.
Figure 3:
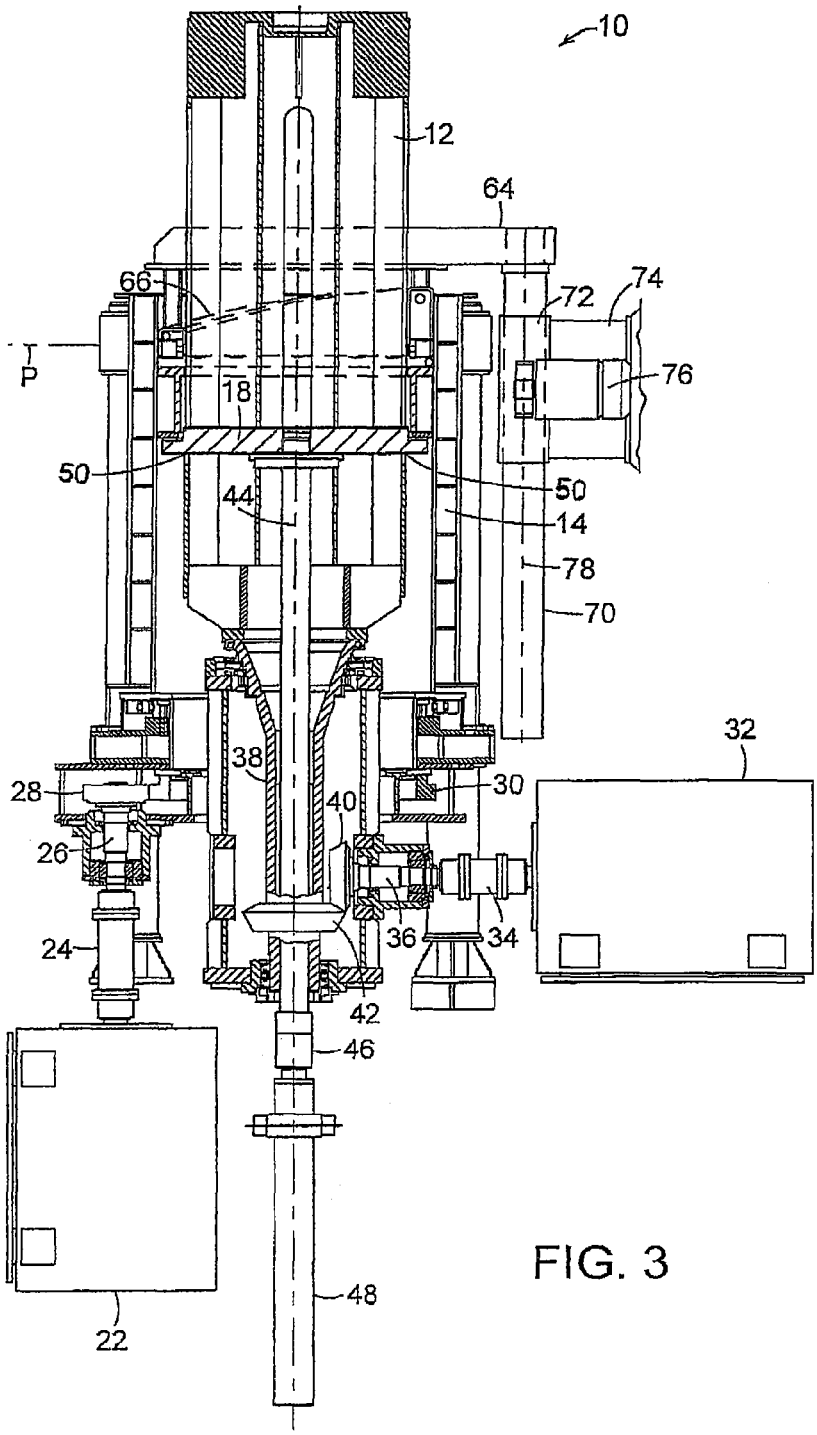
FIG. 3 is a sectional view taken on line 3-3 of FIG. 2.

With reference initially to FIGS. 1-3, a pouring reel in accordance with the present invention is generally depicted at 10. The pouring reel includes a central mast 12 lying on a vertical axis "A". A cylindrical tub 14 surrounds and cooperates with the mast 12 to form an annular coil forming chamber 16. A coil plate 18 defines the bottom of the chamber 16. An entry pipe 20 is arranged to deliver the product traveling at an incoming velocity downwardly at an angle $\alpha$ for accumulation in the chamber 16 as a series of superimposed rings forming an annular coil.

Figure 4:
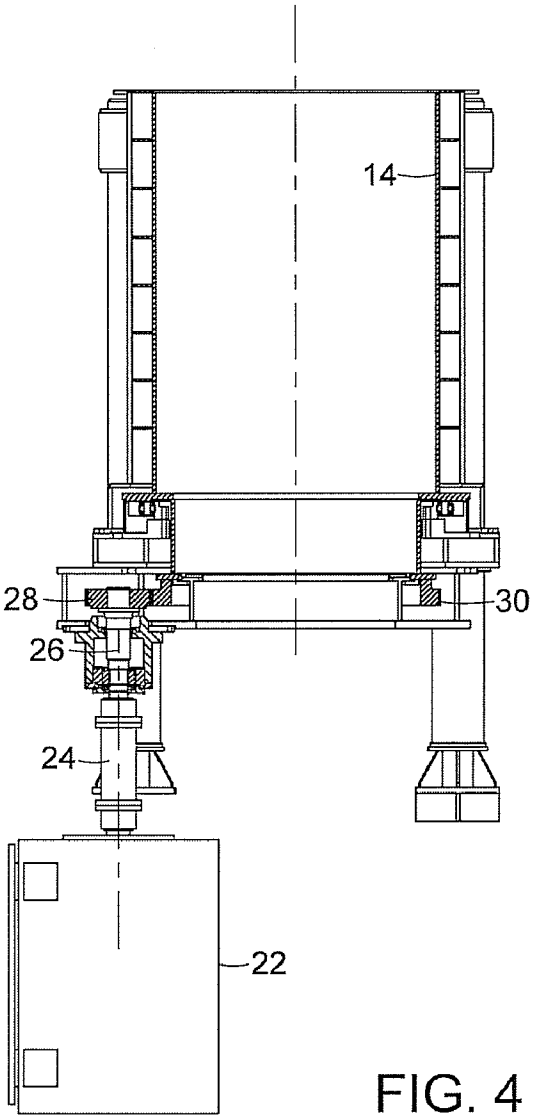
FIG. 4 is a sectional view showing the tub and its drive mechanism.

As can be best seen in FIG. 4, the tub 14 is rotatably driven by a first drive mechanism including a motor 22 connected via a coupling 24 to a stub shaft 26. Shaft 26 carries a pinion gear 28 in meshed relationship with a ring gear 30 on a skirt depending from the tub 14.

Figure 5:
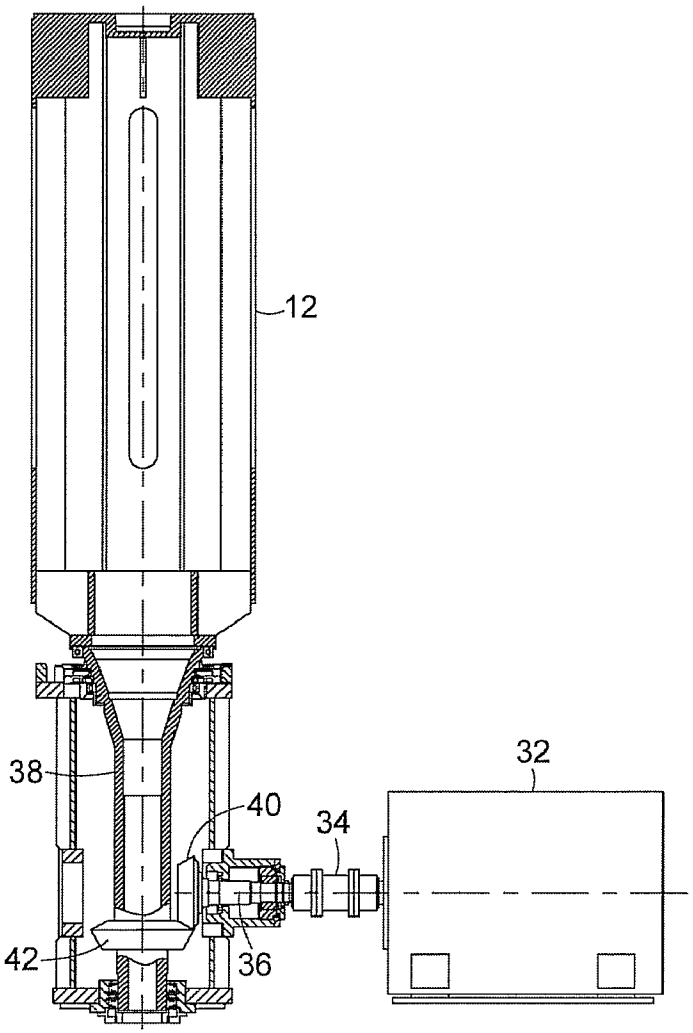
FIG. 5 is a sectional view showing the central mast and its drive mechanism.

As shown in FIG. 5, the mast 12 is driven independently of the tub 14 by a second drive mechanism including motor 32 coupled as at 34 to a stub shaft 36. The mast 12 has a downwardly extending tubular leg 38, with intermeshed bevel gears 40, 42 serving to mechanically couple the tubular mast leg 38 to the stub shaft 36.

The first drive mechanism may be operable to rotatably drive the tub 14 at a speed at which its inner surface has a velocity substantially matching the incoming velocity of the product. The second drive mechanism may be operable independently of the first drive mechanism to rotatably drive the mast 12 at a speed at which its outer surface also substantially matches the product's incoming velocity.

Figure 6:
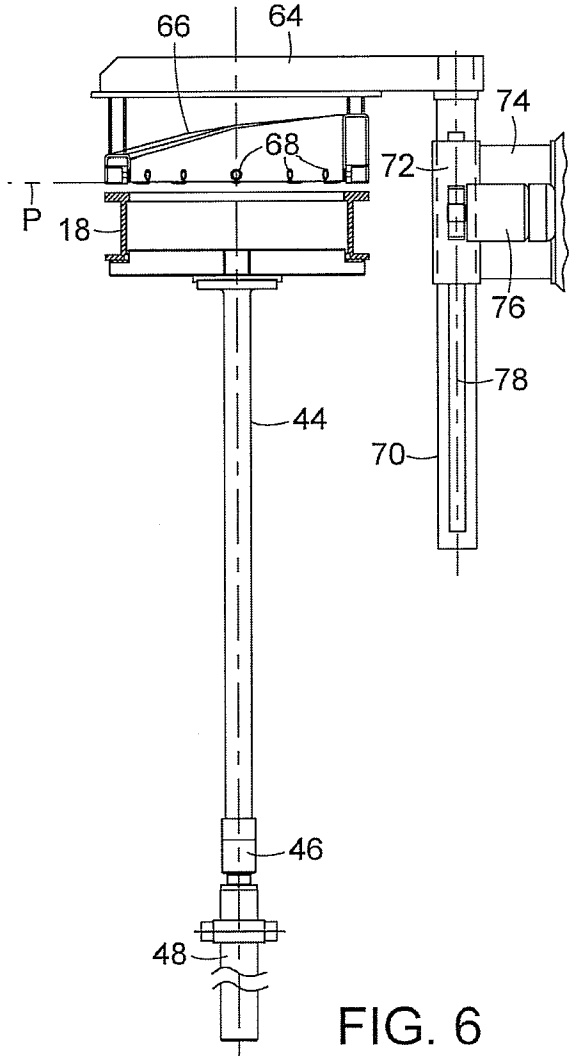
FIG. 6 is a sectional view showing both the coil plate and the entry guide with their respective elevating mechanisms.

With reference to FIG. 6, the coil plate 18 is carried on a vertical stem 44 projecting downwardly through the tubular leg 38 supporting the mast 12. A bearing 46 at the lower end of the stem 44 is engaged by the piston of a lift cylinder 48. With this arrangement, at the conclusion of a coil forming cycle, the lift cylinder may be operated to lift the coil plate 18 in relation to the mast 12 and tub 14 in order to vertically extract a completed coil from the coil forming chamber 16.

As can best be seen in FIG. 3, the coil plate 18 projects through the side wall of the mast 12 as at 50, and is thus mechanically coupled to the mast for rotation therewith about axis A.

The tub 14 is supported by and journalled for rotation within an outer cylindrical housing 52. The housing has vertically disposed external tubes 54 that are slidably supported on fixed vertical legs 56.

Figure 7:
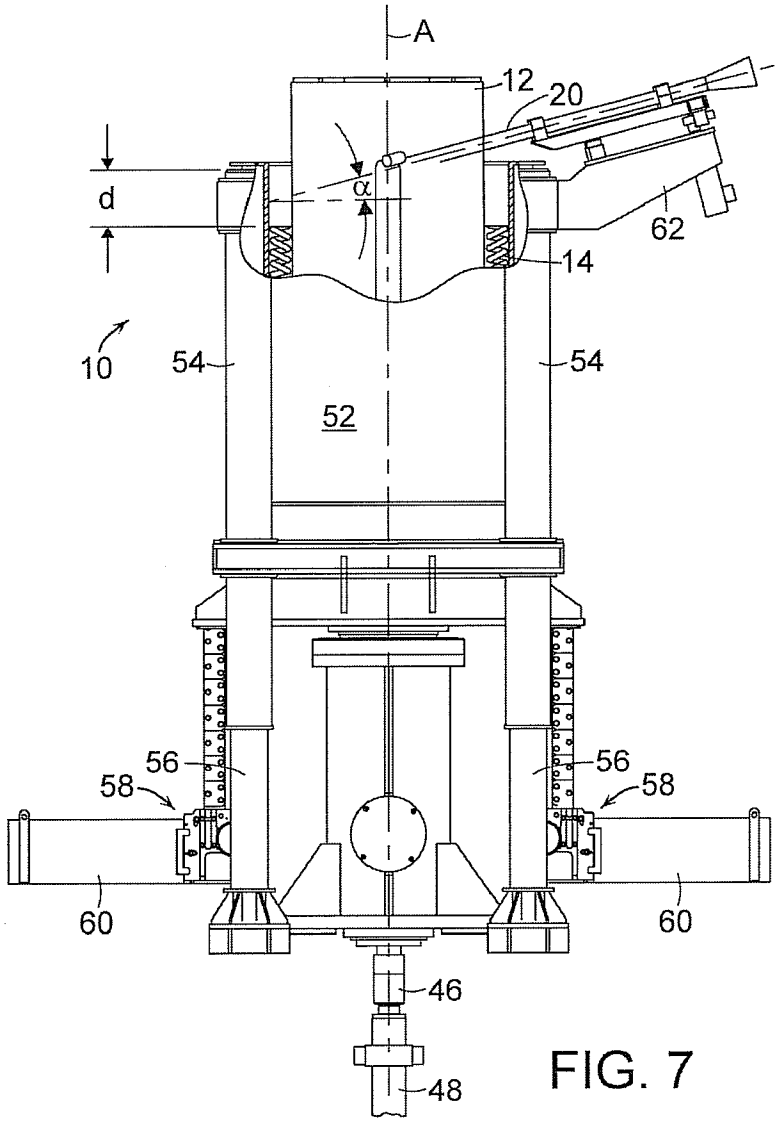
FIG. 7 is a view similar to FIG. 1 showing the pouring reel at the completion of a coil forming cycle.

A third drive mechanism comprising lift chain assemblies 58 powered by motors 60 serves to vertically adjust the outer housing 52 and the tub 14 along axis A. The housing 52 and tub 14 are shown in FIG. 1 at the lowermost position at the start of a coil forming cycle. FIG. 7 shows the housing and tub in the uppermost position at the conclusion of the coil forming cycle.

A bracket 62 serves to mount the entry pipe 20 on the outer housing 52. With this arrangement, the entry pipe is vertically adjustable in unison with the tub 14 and housing 52. Thus, as shown in FIG. 1, the product's free fall distance "d" to the coil plate 18 can be minimized, which in turn allows the entry angle $\alpha$ of the pipe to also be kept relatively small, advantageous less than 14°. As the coiling cycle progresses, the housing 52, tub 14, and entry pipe 20 can be gradually raised while maintaining the free fall distance substantially constant to the very end of the cycle as shown in FIG. 7.

As the tub 14 is gradually raised during a coil forming cycle, there may be a tendency for the most recently deposited product rings in contact with the interior tub surface to be vertically dislodged, thus disrupting the uniformity of the ring pattern. In order to prevent this from happening, and as can best be seen in FIGS. 2, 3, and 6, the present invention preferably includes an entry guide 64 defining a guide path 66 for the product leading downwardly from the entry pipe 20 into the coil forming chamber 16. The entry guide carries a plurality of hold down rollers 68 arranged in a horizontal plane "P" at the terminus of the guide path 64. The guide path is curved and concentric with the axis A.

The entry guide 64 projects in cantilever fashion from a post 70 projecting vertically through a sleeve 72 carried by a fixed bracket 74. A motor driven gear drive 76 engages a rack 78 on the post 70 and serves as a fourth drive mechanism for vertically adjusting the entry guide.

Figure 8:
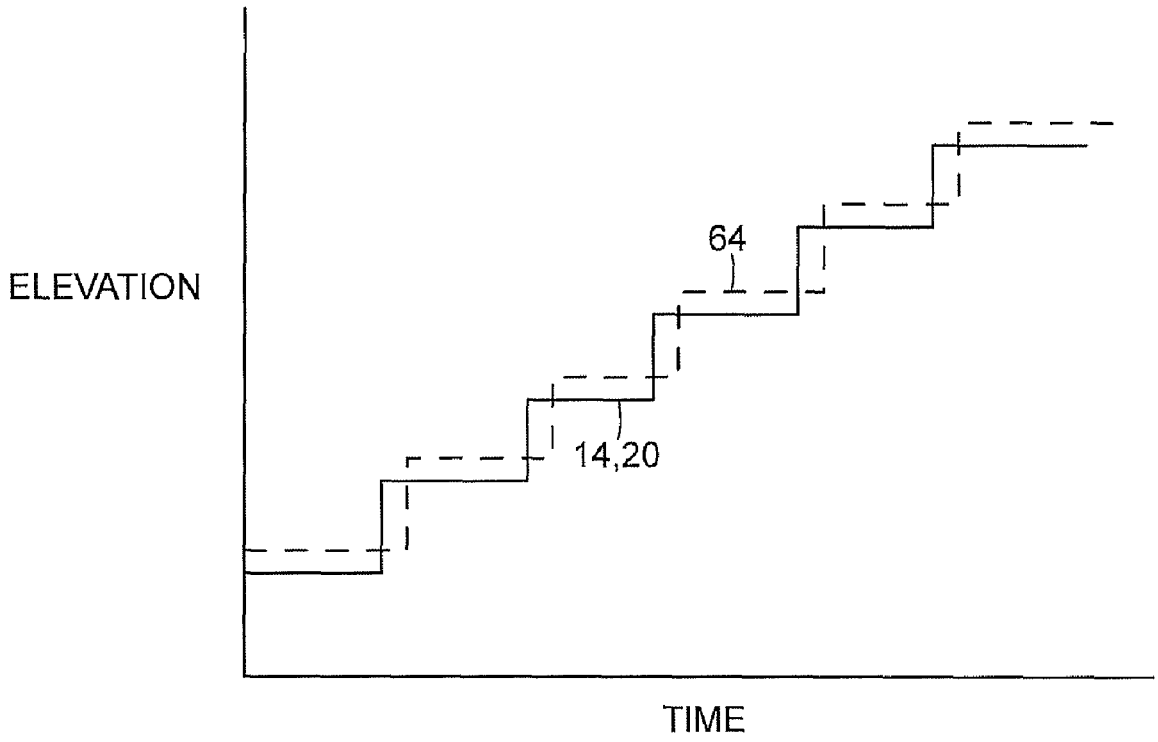
FIG. 8 graphically depicts the stepped manner in which the tub/entry pipe assembly and entry guide are vertically adjusted during the coil forming cycle.

In its operative position, the entry guide 64 overlies the coil forming chamber 16. At the beginning of a coil forming cycle, the entry guide is vertically positioned such that the plane P of the hold down rollers 68 is spaced above the support surface of the coil plate 18 by a "control distance" slightly greater than the diameter of the product being coiled. As each product layer is deposited, the drum 14 and entry pipe 20 are first indexed upwardly by the control distance while the entry guide remains in place, allowing the hold down rollers to contact and vertically confine the underlying rings from being vertically dislodged. The entry guide 64 is then indexed upwardly by the control distance. This stepped operational sequence is depicted in FIG. 8 where the solid and broken lines respectively depict vertical adjustment of the tub/entry pipe assembly and the entry guide.

At the conclusion of a coil forming cycle, and as shown 64' by the broken lines in FIG. 2, the entry guide is pivoted about the axis of post 70 to an inoperative position which allows the completed coil to be vertically expelled from the coil forming chamber.

In light of the foregoing, it will now be appreciated by those skilled in the art that the present invention incorporates a number of advantageous features that contribute to the pouring reel's ability to produce more uniform and stable product coils. More particularly, the ability to drive the central mast 12 and surrounding tub 14 at different speeds that allow their surface velocities to match the incoming product velocity contributes significantly to the uniform distribution of rings within the reforming chamber.

The ability to vertically adjust the entry pipe 20 with the tub 14 enables the free fall distance "d" to be minimized and maintained substantially constant throughout the coil forming cycle, thus further improving ring distribution. The relatively shallow entry angle $\alpha$ minimizes the extent to which the product tail end will project above the top of the finished coil. Optionally, the entry pipe may be oscillated in the horizontal plane in order to further improve ring distribution and coil formation.

The hold down rollers 68 of the vertically adjustable entry guide 64 vertically confine the uppermost rings from being frictionally displaced by vertical tub adjustments, and the curvature of the guide path 66 beneficially preforms the product delivered into the coil forming chamber 16.

Pouring reels may benefit from the inclusion of some but not all of these features. For example, benefits can be derived from vertically adjusting the entry pipe 20 without also differentially driving the mast 12 and tub. The reverse is also true, ie., advantages may be gained by differentially driving the mast and tub, while allowing the entry pipe to remain fixed vertically.

We claim:

1. A pouring reel for forming a long product moving at an incoming velocity into an annular coil, comprising:

a central mast lying on a vertical axis;

a cylindrical tub surrounding and cooperating with said mast to form an annular chamber, said tub being surrounded by and journalled for rotation within an outer housing;

a coil plate defining the bottom of said chamber, said coil plate being rotatably coupled to said mast;

an entry pipe mounted on said outer housing and arranged to deliver the product downwardly for accumulation in said chamber as a series of superimposed rings forming said annular coil;

a first drive mechanism for rotating said tub relative to said outer housing and about said axis;

a second drive mechanism for rotating said mast about said axis, said first and second drive mechanisms being operable simultaneously and independently of each other at different speeds to thereby permit said tub and said mast to be rotated at surface velocities substantially matching the incoming velocity of the product; and a third drive mechanism for vertically adjusting said tub together with said outer housing and the entry pipe mounted thereon relative to said coil plate.

2. The pouring reel of claim 1 wherein said coil plate is mechanically coupled to said mast for rotation therewith about said axis.

3. The pouring reel of claims 1 or 2 further comprising means for vertically adjusting said coil plate in relation to said central mast and said tub.

4. A pouring reel for forming a product moving at an incoming velocity into an annular coil, comprising:

a central mast lying on a vertical axis;

a cylindrical tub surrounding and cooperating with said mast to form an annular chamber, said tub being surrounded by and journalled for rotation within an outer housing;

a coil plate defining the bottom of said chamber, said coil plate being rotatably coupled to said mast;

means for rotatably driving said mast, said tub, and said coil plate;

an entry pipe mounted on said outer housing and arranged to deliver the product downwardly for accumulation in said chamber as a series of superimposed rings forming said annular coil; and means for vertically adjusting said tub, said outer housing and the entry pipe mounted thereon in unison and relative to said coil plate and said mast to thereby maintain the free fall distance of product being delivered into said chamber at a predetermined substantially constant minimum.

5. The pouring reel of claim 4 wherein said entry pipe is arranged to deliver the product at an entry angle of less than 14°.

6. A pouring reel for forming a long product moving at an incoming velocity into an annular coil, comprising:

a central mast lying on a vertical axis;

a cylindrical tub surrounding and cooperating with said mast to form an annular chamber;

a coil plate defining the bottom of said chamber;

an entry pipe arranged to deliver the product downwardly for accumulation in said chamber as a series of superimposed rings forming said annular coil;

a first drive mechanism for rotating said tub about said axis;

a second drive mechanism for rotating said mast about said axis, said first and second drive mechanisms being operable independently of each other to thereby permit said tub and said mast to be rotated at surface velocities and substantially matching the incoming velocity of the product; and an entry guide defining a guide path for said product leading downwardly from said entry pipe into said annular forming chamber, said entry guide having a plurality of hold down rollers arranged in a horizontal plane at the terminus of said guide path, and a fourth drive mechanism for vertically adjusting said entry guide along said axis to maintain said hold down rollers at a selected distance above the uppermost rings accumulating in said chamber.

7. The pouring reel of claim 6 wherein said guide path is curved and concentric with said axis.

8. A method of forming a long product moving at an incoming velocity into an annular coil, comprising:

providing an annular chamber defined between a central mast lying on a vertical axis, and a cylindrical tub surrounding said mast, with a coil plate defining the bottom of said chamber;

delivering the product downwardly for accumulation in said chamber as a series of superimposed rings; and rotating said mast and said tub simultaneously and at different speeds at which their respective surface velocities substantially match the incoming velocity of the product.

9. A method of forming a long product moving at an incoming velocity into an annular coil, comprising:

providing an annular chamber defined between a central mast lying on a vertical axis, and a cylindrical tub surrounding said mast, with a coil plate defining the bottom of said chamber;

rotatably driving said mast, tub, and coil plate;

directing the product downwardly into said chamber via an entry pipe; and vertically adjusting said tub and said entry pipe in unison relative to said coil plate and said mast to thereby maintain the free fall distance of product being delivered into said chamber at a predetermined substantially constant minimum.

* * * * *